United States Patent [19]

Hefti

[11] 4,399,589

[45] Aug. 23, 1983

[54] TRAVERSING APPARATUS FOR A CUTTING MACHINE FOR A SYNTHETIC FILAMENT TOW

[75] Inventor: Walter Hefti, Winterthur, Switzerland

[73] Assignee: Rieter Machine Works Ltd., Winterthur, Switzerland

[21] Appl. No.: 282,959

[22] Filed: Jul. 13, 1981

[30] Foreign Application Priority Data

Jul. 29, 1980 [CH] Switzerland ..... 5776/80

[51] Int. Cl.[3] ..... D01G 1/04

[52] U.S. Cl. ..... 19/0.6; 83/913

[58] Field of Search ..... 19/0.6, 0.62; 83/913

[56] References Cited

U.S. PATENT DOCUMENTS 3,478,392 11/1969 Gorrafa ..... 19/0.62

3,908,232 9/1975 Okayama et al. ..... 19/0.6

FOREIGN PATENT DOCUMENTS 37-14431 9/1962 Japan ..... 19/0.6

46-43267 12/1971 Japan ..... 19/0.6

*Primary Examiner*—Louis Rimrodt

*Attorney, Agent, or Firm*—Werner W. Kleeman

[57] ABSTRACT

In a cutting machine for a synthetic filament tow the filament tow 3 before passing between the cutting rolls 1/2 is traversed laterally to and fro. The present invention teaches, in which manner the traversing movement of the tow guide 5, moved to and fro using a grooved drum 10, is to be effected for obtaining a linear, i.e. optimum, fibre length diagram of the cut fibres. In particular, the mathematic formula for the shape of the guide groove 9, as unrolled in a plane, of the grooved drum 10 is given.

5 Claims, 6 Drawing Figures

Figure 3:
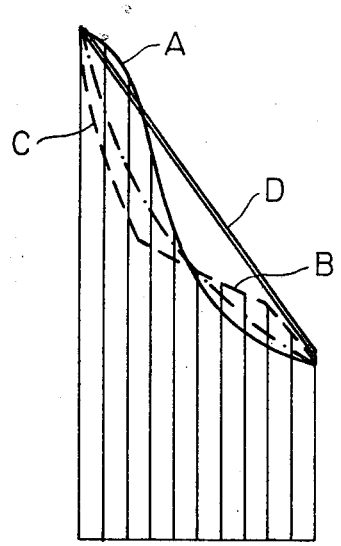

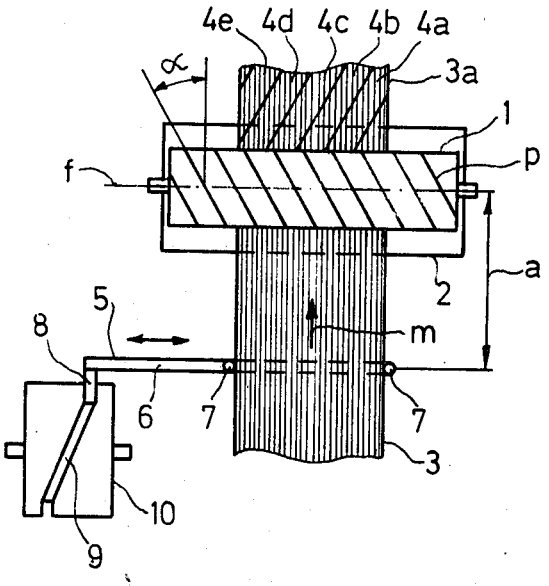
Fig. 1
Fig. 2a
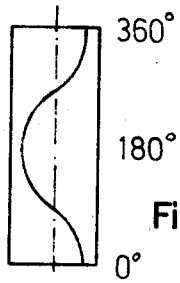
Fig. 2b
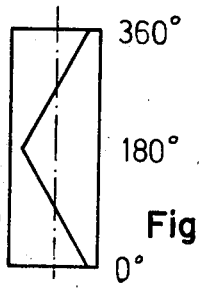
Fig. 2c
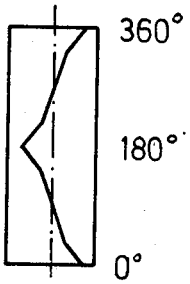
Fig. 5
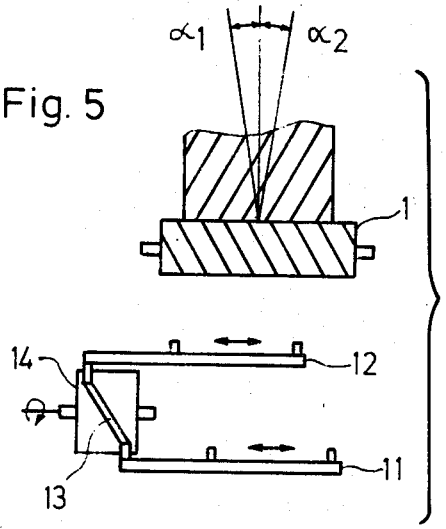
Fig. 6
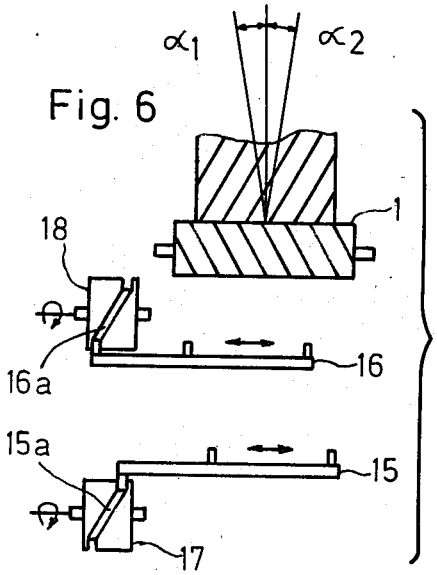

TRAVERSING APPARATUS FOR A CUTTING MACHINE FOR A SYNTHETIC FILAMENT TOW

The present invention concerns a traversing apparatus for a cutting machine for a synthetic filament tow with a pair of cutting rolls defining a cutting line and consisting of a cutting roll and a pressure roll, in which arrangement the cutting roll is provided with cutting edges wound helically onto its surface, extending mutually parallel at equal distances, and with a tow guide traversing parallel to the cutting line, on which guide the filament tow laid out as a wide filament layer is guided on both sides, and which guide effects the traversing movement engaged into the guide-groove provided in the sleeve of a rotating grooved drum.

A cutting machine for a synthetic filament tow, often also called a cutting convertor, is used for transforming the endless filaments of the synthetic filament tow into staple fibres suitable for processing in worsted spinning. It is desirable that the staple fibres are not all of the same length, but that the fibre length varies within a certain length range. In this connection the term fibre length diagram is used, the fibre length diagram based on fibre numbers and the diagram based on fibre weight being defined separately in practical use.

In the fibre length diagram the fibre length is plotted against the percentage of fibres of a given length in the fibre array, the percentage being calculated on the base of the number of fibres, or on the base of the weight of the fibres respectively. The statements within the context of the present invention all refer to the fibre length diagrams based on fibre numbers. Experience has shown, that in cutting synthetic filament tows the best spinning technology characteristics are obtained if the fibre length diagram of the cut fibre material fulfils a well determined relation; namely if the fibre length diagram extends substantially linearly, similar to the diagram of e.g. certain natural fibres as e.g. certain types of wool. The fibre length diagram of a cut fibre tow now can be influenced in different manners, known as such, e.g. by using a multiple-helix cutting roll with varying helical angles of the cutting edges or knives e.g. according to the Japanese Patent Application No. Sho 37-14431, or using a traversing device for the filament tow, as indicated in the broader term of the present invention. The first mentioned known method shows the disadvantage that a limited adaptability only is available, as the tow input width can determine the inclination of the fibre length diagram merely, different cutting rolls thus being required for different mean staple lengths. Furthermore, such cutting rolls of varying helical angles of the knife or knives are complicated and expensive.

In the known solutions in practical use, according to the broader term of the present invention, the use of a grooved drum for moving the traversing device is proposed, in which the shape of the guide groove, as unrolled onto a plane, either corresponds to a sinusoidal curve, or extends linearly, possibly with different inclination increments. These known shapes of the unrolled guide groove show the disadvantage, that the fibre length diagram obtained with them deviates too much from the optimum fibre length diagram extending linearly as desired. The result of undesirable fibre length diagrams is a bad quality of the goods produced.

It thus is the objective of the present invention to eliminate the disadvantages of a traversing device for a cutting machine according to the broader term mentioned of the state of the art mentioned before, and to propose a grooved drum for the traversing device, using which cutting of the filament tow to fibres with an optimum, linear fibre length diagram is ensured.

Figure 4:
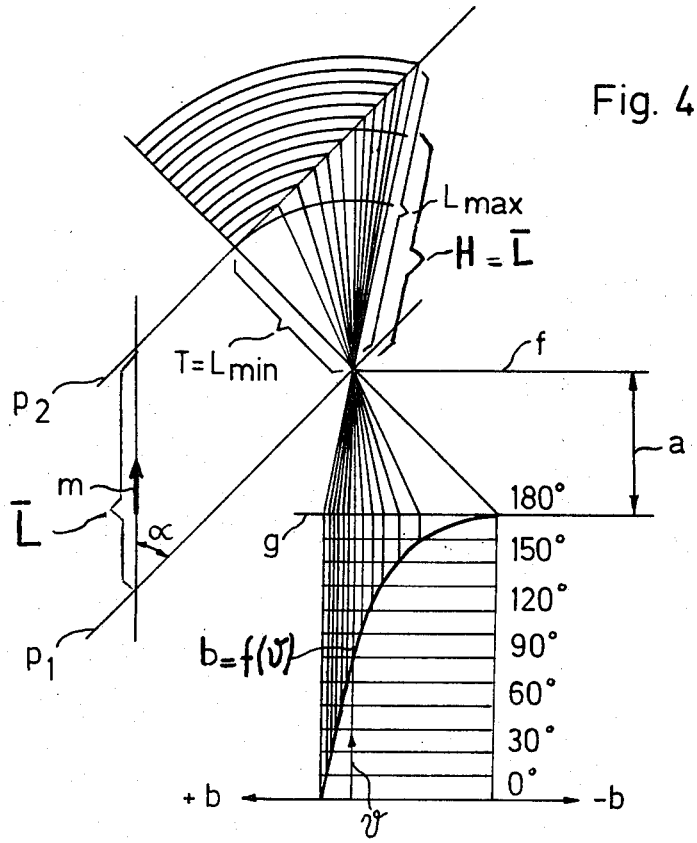

The present invention is described in more detail in the following with reference to illustrated design examples. It is shown in:

FIG. 1 the traversing apparatus in a schematic, much simplified view,

FIGS. 2*a*, 2*b* and 2*c* respectively illustrate three shapes of the guide groove, as unrolled in a plane, of the grooved drum according to the state of the art, FIG. 3 the three fibre length diagrams A, B and C corresponding to the three unrolled shapes a, b and c according to FIG. 2, and the fibre length diagram D of linear, optimum characteristic corresponding to the shape of the guide groove according to FIG. 4, FIG. 4 the shape of the guide groove, as unrolled in a plane, according to the invention, graphically for a certain special case, in which the desired minimum fibre length $L_{min}$ is equal to the minimum staple length achievable using a given cutting roll, FIG. 5 an alternative design example of the inventive traversing apparatus with two traversing devices for two filament tows supplied, driven by one single grooved drum, FIG. 6 a further alternative design example of the inventive traversing apparatus with two traversing devices for two filament tows, each device being driven by a separate grooved drum each.

In FIG. 1 the cutting roll is designated 1, the pressure roll of a pair of cutting rolls, known as such, is designated 2. On their line of contact, where the filament tow 3, passing between them, is cut into staple fibres, the two rolls 1 and 2 define a cutting line f. The cutting roll 1 is provided with cutting edges p wound helically onto its surface, extending parallel at equal mutual distances with a helix angle $\alpha$.

The filament tow 3, which moves in the direction of the arrow m and is transported, or supplied respectively, by means not shown as a filament layer spread wide, upstreams from the pair of rolls 1/2 consists of a very large number of endless filaments, which are arranged strictly parallel in the tow array. Upon leaving the pair of rolls 1/2, or the cutting line f respectively, the tow 3*a* now consists of staggered, trapezoidal (in a first approximation at least) fibre groups 4*a*, 4*b*, 4*c*, etc., which in principle are completely severed and separated mutually, and thus should eliminate any cohesion of the tow 3*a*. In practical application, however, some cohesion remains also in the cut tow, such that it can be transported further, after the cutting operation, as a large, coherent fibre web.

In order to obtain an inclination of the fibre length diagram, the filament tow 3 is to effect a traversing movement with respect to the pair of rolls 1/2. It is known, that the traversing movement of the filament tow 3 can be effected using a tow guide 5 arranged at a distance a from the cutting line f (as seen in the direction of transport of the filament tow 3). The tow guide 5 substantially consists of a horizontal rod 6 supporting two lateral guides 7 extending upwards, e.g. in the form of a short pin. The distance between the two lateral guides 7, which can be adjustable (not shown), is chosen such in this arrangement, that the filament tow 3 is guided tightly at both sides, spread wide on the portion of the rod 6 between the two guides 7, i.e. as a compact tow. The filament tow 3 thus is to be guided laterally in such a manner, that it follows any lateral movement of the tow guide 5, but without being buckled on the lateral guides.

The lateral movement of the tow guide 5 is effected according a known method, the rod 6 engaging, e.g. using a roll 8 connected therewith, with the guide groove 9 provided in the sleeve of a rotating grooved drum 10. It should be mentioned, however, already here, that instead of a grooved drum 10 any other type of guide curve, multiple linkages, etc., could be applied also within the scope of the present invention.

The present invention now is based on the finding, that the traversing movement not only is suitable for the above mentioned purpose, but also that it decisively influences the shape of the fibre length diagram of the fibres cut.

In FIGS. 2(*a*) through (*c*) three shapes of the guide groove 9, as unrolled on a plane, of the grooved drum 10 are shown, as known in practical use.

In FIG. 2(*a*) a sinusoidal shape of the guide groove is shown, in FIG. 2(*b*) a simple, linear curve, whereas in FIG. 2(*c*) the case is shown, in which the speed of the traversing movement at the reversal points of the movement is to be increased with respect to the average traversing speed. These three shapes of the guide groove 9 are well known in practical applications of various types and are applied mainly in connection with traversing thread guides for depositing a longitudinally oriented fibre array, such as e.g. a yarn or a roving, on the surface of a bobbin package. Such groove shapes were developed particularly in view of the problems of bobbin package formation (e.g. the requirement to avoid material accumulations at the bobbin edges, for which purpose higher speed of the thread guide at the reversal points, as shown in FIG. 2(*c*), is applied), and permit satisfactorily to overcome the respective problems. These groove shapes, however, were also applied in the cutting machine being the object of the present invention, without taking into account, that here the traversing movement of the filament tow 3 is to fulfil quite different requirements. The lateral movement of the filament tow 3 effects a correction of the length of the fibres cut by two cutting edges passing in sequence over the roll surface, in which manner the fibre length diagram of the fibre material cut is influenced.

In FIG. 3 the three fibre length diagrams A, B and C, corresponding to the three shapes of the guide grooves according to FIGS. 2*a*, 2*b* and 2*c* respectively, compared to fibre length diagram D of linear shape, are shown, which according to experience is optimum. As visualized, all curves A, B and C deviate more or less substantially from the optimum shape D. This inevitably is reflected in the quality of the goods produced from fibres cut correspondingly.

The present invention now clearly teaches, which shape of the guide groove 9 corresponds to the ideal fibre length diagram extending linearly according to diagram D shown in FIG. 3. For obtaining this diagram, the shape of the guide groove 9, as unrolled on a plane, is to correspond to the curve as defined by the relation given in claim 1.

In FIG. 4 the relation according to claim 1 was graphically constructed and visualized, for a certain special case, namely the one in which the desired shortest staple length $L_{min}$ is to be equal to the minimum staple length achievable using a given cutting roll, and in which the desired mean staple length H corresponds to the cutting roll staple length $\overline{L}$. H, however, not necessarily is to correspond to $\overline{L}$, as the means staple length H is not determined by the cutting roll, but by the relation $(L_{max}+L_{min})/2$. This signifies, that the means staple length H can differ from $\overline{L}$, and that thus e.g. using an 88 mm-cutting roll ($\overline{L}=88$), depending on the shape of the curve, any mean staple length ranging from 70 to 90 mm can be cut. It is however advantageous if $H=(L_{max}+L_{min})/2$ is chosen in the vicinity of $\overline{L}=T/\sin\alpha$.

The two lines $p_1$ and $p_2$, the mutual distance of which is designated T, shown under an angle $\alpha$=helical angle of the cutting edge, with respect to the direction of transport of the material indicated by arrow m (according to FIG. 1), visualize two neighboring cutting edges arranged on the cutting roll surface.

The shape of the guide groove now in FIG. 4 was graphically constructed for the special case, in which the minimum fibre length $L_{min}$ corresponds to the distance T of neighbouring cutting edges ($L_{min}=T$). This corresponds to the case, in which the fibres at a certain moment during the traversing movement are cut while extended at right angles with respect to the cutting edges.

If H and $L_{min}$ are given, or chosen, respectively, $L_{max}$ also is known automatically. Furthermore in FIG. 4 the cutting line f between the rolls of the pair of cutting rolls 1/2 is shown, whereas the line g indicates the position of the tow guide 5. The distance between the lines f and g is designated a (corresponding to the relation according to claim 1).

The construction of the curve b, in function of the centre angle $\upsilon$ of the unrolled drum surface is visualized from the graphical design, $\upsilon$ being varied only between 0° and 180°, in such a manner that only half of the unrolled drum surface, and of the guide groove 9, respectively, is shown. The other half of the curve of course is mirrored symmetrically.

The relation, or formula, according to claim 1, for b now permits calculation of the unrolled shape of the guide groove, without relying on the graphical construction. The relations between the shown graphical construction of the curve $b=f(\upsilon)$, according to the example shown in FIG. 4 and the mathematical formula according to claim 1 are clear to any mathematician and do not require further explanation here.

Of course, the shape of the guide groove 9, as unrolled in a plane, can be constructed, or calculated respectively, graphically as well as mathematically for the case in which $L_{min}>T$.

The shape of the guide groove 9, calculated according to claim 1, or graphically constructed according to the example of FIG. 4, respectively, yields a corresponding fibre length diagram, which extends linearly, as indicated in FIG. 3 with the diagram D.

If now, as shown in the example according to FIG. 1, a single filament tow 3 is supplied to the pair of cutting rolls 1/2, it is obvious, that the length of the fibres cut varies with the position of the tow guide 5: if the tow guide 5 is in its extreme left hand position, the longest fibres result (comp. FIG. 4), whereas, if the tow guide 5 reaches its extreme position at the right hand side, the shortest fibres are cut. In other words, even if the fibre length diagram of the fibres in the cut tow 3*a* is optimum, i.e. linear, the length distribution of the fibres along the tow 3*a* is extremely periodical, the period corresponding to the one of the traversing movement of the tow guide 5. For elimination of this disadvantage it is recommended to supply more than one single filament tow simultaneously, e.g. two tows via different tow guides the traversing movements of which are phase-shifted, to the pair of cutting rolls 1/2. Thus, automatically a so-called doubling effect results, in which a zone of a first filament tow cut into short fibres is overlapped with a zone of a second filament tow cut into long fibres. In each cross-section of the overlapped filament tow thus practically fibres of different length are present.

In FIGS. 5 and 6 an example each is shown of a cutting machine with two filament tows (not shown), each guided in a different plane. In FIG. 5 a tow guide 11 and 12 are shown, each provided for one of the filament tows which substantially are provided superimposed, in such a manner, that the two filament tows are guided through the pair of cutting rolls (the cutting roll 1 only being shown) in an overlapped state, and each of the two guides 11 and 12 is shown engaging with the guide groove 13 of a common, rotating groove drum 14, the guide groove 13 fulfilling the relation according to claim 1 for traversing the guides. If, as in the example illustrated, the two tow guides 11 and 12 engage the guide groove 13 of the grooved drum 14 at two diametrically opposed points, automatically a phase-shift between the traversing movements of the two guides of 180 degrees is obtained. Other phase-shift angles of course also could be achieved.

In FIG. 6, on the other hand, the case is illustrated, in which the two tow guides 15 and 16 engage with two separate grooved drums 17 and 18, the two grooved drums 17 and 18 can contain guide grooves 15*a*, 16*a* of the same dimensions and shape, or can be of different dimensions and shapes. Also their mutual phase-shift angle can be chosen as desired.

The traversing device according to the invention can be applied also with more than two filament tows, advantageously supplied in an overlapped state, in which arrangement the rule prevails: the more doublings, the better the distribution of the cut fibre lengths in the cut tow 3*a*. Concerning the shape of the fibre length diagram, however, a single filament tow is sufficient for ensuring an optimum, linear characteristic of the diagram, using the inventive traversing apparatus.

Apparatus for cutting filament tow comprising a rotatable cutting roll provided with a cutting edge and traversing means for traversing the tow longitudinally of the cutting roll, the traversing means being so operable in relation to the roll as to provide a substantially predetermined staple diagram in the cut tow. Preferably the staple diagram is substantially linear. The cutting edge may extend helically around the roll. The traversing means may comprise cam means having a cam surface the shape of which is so selected relative to said cutting roll as to provide said predetermined staple diagram.

While there are shown and described present preferred embodiments of the invention, it is to be distinctly understood that the invention is not limited thereto, but may be otherwise variously embodied and practiced within the scope of the following claims. Accordingly,

I claim:

1. Traversing apparatus for a cutting machine for a synthetic filament tow with a pair of cutting rolls (1/2) defining a cutting line (f) and consisting of a cutting roll (1) and a pressure roll (2), in which arrangement the cutting roll is provided with cutting edges wound helically onto its surface, extending mutually parallel at equal distances, and with a tow guide (5; 11,12; 15,16), traversing parallel to the cutting line (f), arranged, seen in the direction of material flow, upstreams from the cutting line (f), on which guide the filament tow (3) laid-out as a wide filament layer is guided on both sides, and which guide effects the traversing movement engaged into the guide-groove (9;13) provided in the sleeve of a rotating grooved drum (10; 14; 17,18), characterized in that the shape of the guide-groove (9;13), unrolled onto a plane, fulfils the following relation:

$$b = \pm a \cdot tg\left[\alpha\text{-arc sin}\left(\frac{180 \cdot \bar{L} \cdot \sin\alpha}{180 \cdot L_{max} - \theta(L_{max} - L_{min})}\right)\right]$$

where b = traversing path length of the tow guide (5; 11,12; 15,16)

a = distance between the tow guide (5; 11,12; 15,16) and the cutting line (f)

$\alpha$ = helix angle of the cutting edge $L_{max}$ = maximum fibre length in the cut fibre array (3*a*)

$L_{min}$ = minimum fibre length in the cut fibre array (3*a*)

$\upsilon$ = centre angle of the unrolled drum surface $\bar{L}$ = cutting roll staple length = (cutting roll dia-$\cdot\pi$)/$G = T/\sin\alpha$ where T = distance between two adjacent cutting edges G = number of cutting edge wraps.

2. Traversing apparatus according to claim 1, characterized in that two filament tows are supplied to the pair of cutting rolls (1/2) and are cut in an overlapping state, and that each filament tow is guided in a tow guide (11,12), through which it passes as a wide laid-out filament layer, on both sides, and that the two tow guides (11,12) are arranged substantially superimposed and are traversed as they are engaged in the guide groove (13) of a common, rotating grooved drum (14), the guide groove (13) fulfilling the relation according to claim 1.

3. Traversing apparatus according to claim 2, characterized in that the two tow guides (11,12) engage the guide groove (13) of the grooved drum (14) at two diametrically opposed points.

4. Traversing apparatus according to claim 1, characterized in that two filament tows are supplied to the pair of cutting rolls (1/2) and are cut in an overlapping state, and that each filament tow is guided in a tow guide (15,16), through which it passes as a wide layed-out filament layer, on both sides, and that the two tow guides (15,16) are arranged substantially superimposed, each of them being traversed as it engages the guide groove (15*a*,16*a*) of a separate, rotating grooved drum each (17,18), the guide groove fulfilling the relation according to claim 1.

5. Traversing apparatus according to claim 1, characterized in that the two grooved drums (17,18) are of the same dimensions and of the same guide groove shape (15*a*,16*a*), and that the tow guides (15,16) move at a mutual phase difference corresponding substantially to one traversing path length.

* * * * *

UNITED STATES PATENT AND TRADEMARK OFFICE

CERTIFICATE OF CORRECTION

PATENT NO. : 4,399,589

DATED : August 23, 1983

INVENTOR(S) : WALTER HEFTI

It is certified that error appears in the above-identified patent and that said Letters Patent are hereby corrected as shown below:

Column 6, line 15 in the equation read "$\theta$" as --$\vartheta$--

Signed and Sealed this

*Twenty-fifth* Day of *October 1983*

[SEAL]

*Attest:*

GERALD J. MOSSINGHOFF

*Attesting Officer*

*Commissioner of Patents and Trademarks*